US005201169A

United States Patent [19]

Miyashita

[11] Patent Number: 5,201,169

[45] Date of Patent: Apr. 13, 1993

[54] METALLIC-FOIL-COVERED FANCY YARN AND METHOD OF FAN APPARATUS FOR MANUFACTURING SAME

[76] Inventor: Toru Miyashita, 18-1, Itodashin-machi, Kanazawa-shi Ishikawa 921, Japan

[21] Appl. No.: 773,919

[22] PCT Filed: Mar. 1, 1990

[86] PCT No.: PCT/JP90/00271

§ 371 Date: Oct. 25, 1991

§ 102(e) Date: Oct. 25, 1991

[87] PCT Pub. No.: WO91/13196

PCT Pub. Date: Sep. 5, 1991

[51] Int. Cl.[5] ..... D02G 3/02

[52] U.S. Cl. ..... 57/7; 57/295

[58] Field of Search ..... 57/210, 232, 233, 234, 57/258, 7, 8, 295, 296, 297, 309, 333; 28/220, 219, 217

[56] References Cited

U.S. PATENT DOCUMENTS

| | | | |
|---|---|---|---|
| 2,007,183 | 7/1935 | Dickie et al. | 57/295 X |
| 2,058,783 | 10/1936 | Franke | 57/233 X |
| 2,230,271 | 2/1941 | Simpson | 57/297 |

FOREIGN PATENT DOCUMENTS

| | | | |
|---|---|---|---|
| 3408795 | 9/1985 | Fed. Rep. of Germany | 57/296 |
| 1143690 | 10/1957 | France | 57/7 |
| 75869 | 4/1986 | Japan . | |
| 201541 | 8/1989 | Japan | 57/233 |
| 61123 | 3/1990 | Japan | 57/295 |

*Primary Examiner*—Joseph J. Hail, III

*Attorney, Agent, or Firm*—Bauer & Schaffer

[57] ABSTRACT

A fancy yarn has a plurality of metallic foil pieces wrapped around and attached to the surface of a yarn by an adhesive. The fancy yarn is manufactured by applying an adhesive to a yarn supplied from a supply bobbin, aerially holding the yarn under tension, attaching scattered metallic foil pieces to adhesive-applied regions of the yarn, twisting the yarn with the attached metallic foil pieces or generating swirling air streams around the yarn to wrap the yarn with the attached metallic foil pieces, and hardening the adhesive to secure the wrapped metallic foil pieces to the yarn. The fancy yarn with its surface made glossy by the attached foil pieces can simply be manufactured. A fancy yarn comprising a thin yarn wrapped with foil pieces can also be manufactured with ease. A woven fabric of high ornamental effect can be produced of the fancy yarn that is used as weft or warp threads.

4 Claims, 4 Drawing Sheets

METALLIC-FOIL-COVERED FANCY YARN AND METHOD OF FAN APPARATUS FOR MANUFACTURING SAME

DESCRIPTION

1. Technical Field

The present invention relates to a fancy yarn covered with gold or silver foil, and more particularly to a gold or silver yarn or thread for use as a warp or weft yarn for woven fabric, and a method of and an apparatus for manufacturing such a gold or silver yarn.

2. Background Art

It has long been customary to manufacture a gold or silver yarn by covering a narrow piece of cloth with gold or silver foil and twisting the covered piece of cloth. It is also known to manufacture a gold or silver yarn by coating the yarn with a layer of resin mixed with gold or silver powder.

Japanese Laid-Open Patent Publication No. 61-75869 published on Apr. 18, 1986 discloses, as shown FIG. 7 of the accompanying drawings, a transfer roller 26 and a contacting/separating device 25 which are disposed along a yarn 2 from a bobbin 1. When the contacting-/separating device 25 is controlled to move in a certain pattern by a controller 41 and a driver 23, the yarn 2 is selectively brought into and out of contact with the transfer roller 26. A liquid 42 composed of an adhesive and metal powder mixed therein and contained in a container 3 is therefore applied at random to the yarn 2 over a desired length. The yarn 2 with the liquid 42 applied thereto is thereafter dried by a heater 12 and wound around a tape-up bobbin 13.

The process of manufacturing a gold or silver yarn by covering a narrow piece of cloth with gold or silver foil and twisting the covered piece of cloth, requires a large amount of foil. Therefore, the gold yarn produced with gold foil applied to the narrow piece of cloth is very expensive. The process also requires a lot of skill in applying the foil to the narrow piece of cloth. Furthermore, it is difficult to produce a thin gold or silver yarn, and hence a woven fabric of such gold or silver yarn for use as a garment.

According to the process of applying resin with mixed metal powder to a yarn, the yarn cannot be given a shiny metallic finish that would otherwise be possible with metallic foil, but only a dull metallic gloss. Therefore, any woven fabric of such yarn is of a low ornamental effect. Another problem is that the yarn is not flexible enough because of the resin layer of certain thickness on the surface of the yarn.

It is an object of the present invention to provide a fancy yarn which has a shiny metallic gloss on its surface and can be used to produce a garment fabric of high ornamental effect, and a method of and an apparatus for manufacturing such a fancy yarn simply and inexpensively.

DISCLOSURE OF THE INVENTION

To give the surface of a yarn a foil gloss, a metallic foil may be wrapped around the surface of the yarn. Since, however, a metal foil has been hammered into a limit thickness, it is technically difficult to cover the yarn with the metallic foil because the metallic foil tends to shrink or curl around a region where it is gripped. It would be possible to wrap a yarn with a long ribbon-shaped foil and cut off gripped ends of the foil. However, larger foil is much more expensive than smaller foil, and it would not be easy to design a wrapping device and adjust the wrapping device according to the thickness of the yarn.

According to the present invention, metallic foil pieces 9 are scattered over and applied to a yarn 2 held under tension, and then the yarn 2 is twisted (see FIG. 1), or a swirling air stream is developed around the yarn (see FIG. 3), thereby wrapping the yarn 2 with the foil pieces 9 applied to the yarn 2.

The yarn 2 to which the foil pieces 9 are to be applied is coated with an adhesive 4 in advance. The adhesive 4 should preferably be flexible enough even when it is in a solid state, so that the flexibility of the yarn 2 will not be impaired by the adhesive 4. For example, the adhesive 4 may be of acrylic resin or urethane resin. Preferably, the adhesive 4 is applied in as thin a layer as possible. If a woven cloth with a high design effect is to be made of the yarn 2, then the adhesive 4 should be applied to local regions of the yarn 2.

To apply the adhesive 4 and hence foil pieces 9 to constant lengths of the yarn 2 at constant spaced intervals, the yarn 2 may be passed between a toothed transfer roller 6 (see FIG. 1) for transferring the adhesive 4 and a presser roller 7. To vary intervals between and lengths of adhesive-coated regions of the yarn 2, the yarn 2 may be moved into and out of contact with a transfer roller 26 (see FIG. 4) by a contacting/separating guide 25 that is vertically movable under the control of a computer. The yarn 2 to which the adhesive 4 is applied in its entirety or local regions is held under tension horizontally or obliquely, and fed in the direction in which it is tensioned while at the same time gold or silver foil pieces 9 are scattered over the yarn 2. The foil pieces 9 should preferably be in the form of small foil fragments of irregular shape. The foil pieces 9 are partially attached to the yarn 2 by the adhesive 4 applied to the yarn 2. The foil pieces 9 attached to the yarn 2 are then wrapped around the yarn 2 either due to inertia or air resistance when the yarn 2 is twisted, or by swirling air streams 19 (see FIGS. 2 and 3) developed in an air pipe 17 by inclined nozzles 18.

The foil pieces 9 that have dropped onto the yarn 2 have portions attached to the yarn 2 by the adhesive 4, and the remaining portions of the foil pieces 9 are wrapped around the yarn 2 by the twisting of the yarn 2 or the swirling air flows. Those foil pieces 9 which are not attached to the yarn 2 return to hoppers 8, 27. A rotary hopper 27 shown in FIG. 7 is effective to generate swirling air streams around the yarn 2 with hopper blades *27c* as they rotate. In the case where the foil pieces 9 are in the form of small foil fragments, no single foil piece will not be wrapped in layers around the yarn 2, and another foil will be attached to one foil piece that has been wrapped around the yarn 2.

The metallic gloss imparted to the surface of the fancy yarn thus produced is highly shiny as it is given by the foil wrapped around the yarn.

BEST MODE FOR CARRYING OUT THE INVENTION

Figure 1:
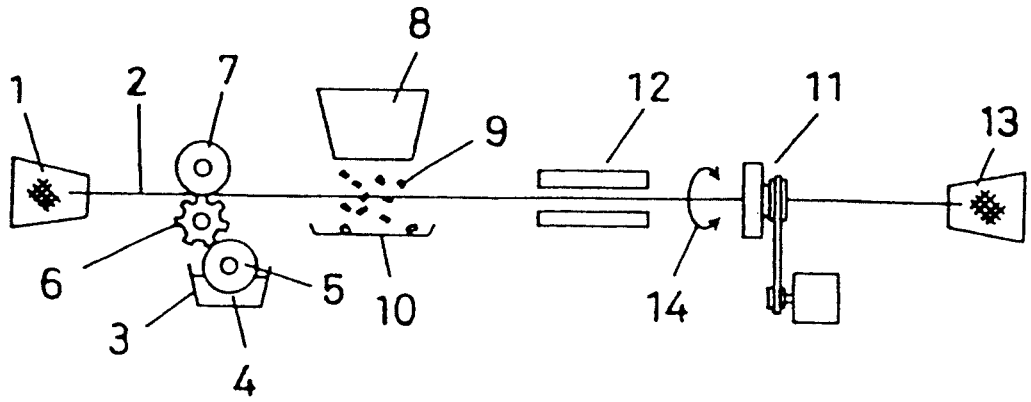
FIG. 1 is a side elevational view of an apparatus according to a first embodiment of the present invention.

FIG. 1 shows, in side elevation, an apparatus according to a first embodiment of the present invention.

In FIG. 1, a yarn 2 to be processed is supplied from a supply bobbin 1. The yarn 2 supplied from the supply bobbin 1 extends under tension from the supply bobbin 1 to a take-up bobbin 13. The apparatus has an adhesive container 3 that contains an adhesive 4 which may be of acrylic resin or urethane resin, and a pickup roller 5 that is partly immersed in the adhesive 4 in the adhesive container 3. The apparatus also includes a toothed transfer roller 6 for transferring the adhesive 4 to the yarn 2, a presser roller 7 for pressing the yarn 2 against the toothed transfer roller 6, a hopper 8 for scattering small gold or silver foil pieces 9 over the yarn 2, a tray 10 for receiving the foil pieces 9 dropped from the hopper 8, a yarn twister 11, and a heater 12. The take-up bobbin 13 can be rotated by an actuator.

The yarn 2 supplied from the supply bobbin 1 is horizontally held under tension, fed in the direction in which it is held under tension, and then wound around the take-up bobbin 13. The yarn twister 11 is rotated repeatedly in one direction and then the other at constant timing for rotating the yarn 2 about its own axis in the directions indicated by the arrows 14. The toothed transfer roller 6 transfers the adhesive 4 from the adhesive container 3 to the yarn 2 when the top surface of each tooth thereof contacts the yarn 2. The adhesive 4 is thus applied to the yarn 2 at its discrete regions by the toothed transfer roller 6. The yarn 2 with the adhesive 4 applied is then guided below the hopper 8. Some of the foil pieces 9 that have been scattered from the hopper 8 are trapped by the adhesive 4 on the yarn 2, whereas the remaining foil pieces 9 are accumulated in the tray 10. The trapped foil pieces 9 are then wrapped around the yarn 2 as the yarn 2 is rotated reciprocally in the opposite directions. The yarn 2 wrapped with the foil pieces 9 is thereafter introduced into the heater 12, in which the adhesive 4 is hardened with heat to fix the wrapped foil pieces 9. Then, the yarn 2 is wound around the take-up bobbin 13.

Figure 2:
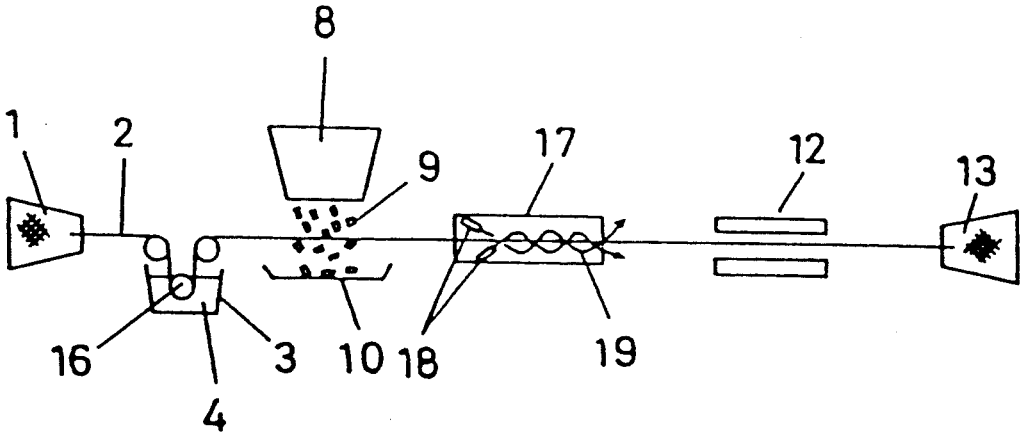
FIG. 2 is a side elevational view of an apparatus according to a second embodiment of the present invention.
Figure 3:
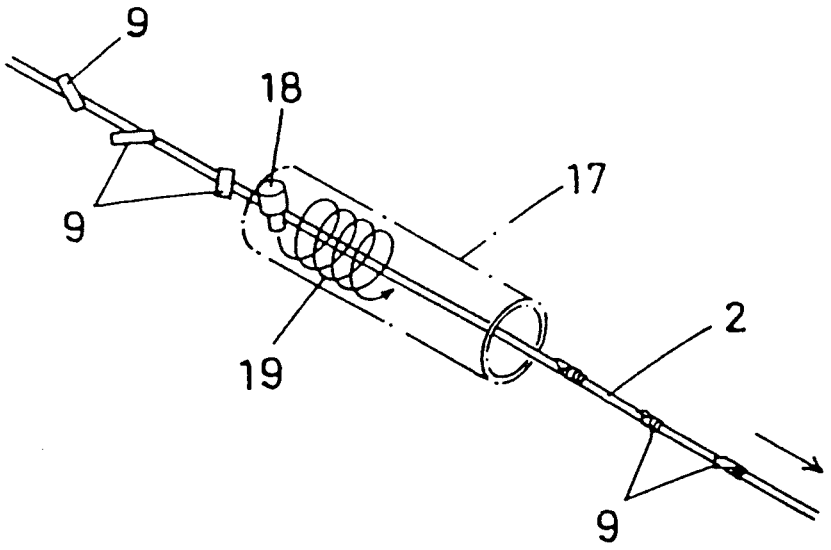
FIG. 3 is a perspective view of a wrapping section of the apparatus shown in FIG. 2.

FIGS. 2 and 3 show an apparatus according to a second embodiment of the present invention. FIG. 2 shows the apparatus as a whole in side elevation, and FIG. 3 shows a wrapping section in perspective. A supply bobbin 1, a yarn 2, an adhesive container 3, an adhesive 4, a hopper 8, foil pieces 9, a tray 10, a heater 12, and a take-up bobbin 13 shown in FIGS. 2 and 3 are identical to those according to the first embodiment shown in FIG. 1. The apparatus according to the second embodiment includes a dipping roller 16 supported by a shaft in the adhesive container 3, a tunnel-shaped air pipe 17 surrounding the yarn 2 held under tension, and inclined nozzles 18 disposed in the air pipe 17. The inclined nozzles 18 eject air flows that serve as swirling air streams 19.

In the second embodiment, the yarn 2 supplied from the supply bobbin 1 is dipped in the adhesive 4 in the adhesive container 3, so that the adhesive 4 is applied to the entire length of the yarn 2. The foil pieces 9 scattered from the hopper 8 are applied to the yarn 2 by the adhesive 4. Then, the yarn 2 is introduced into the air pipe 17 in which the foil pieces 9 are wrapped around the yarn 2 by the swirling air streams 19 in the air pipe 17.

Figure 4:
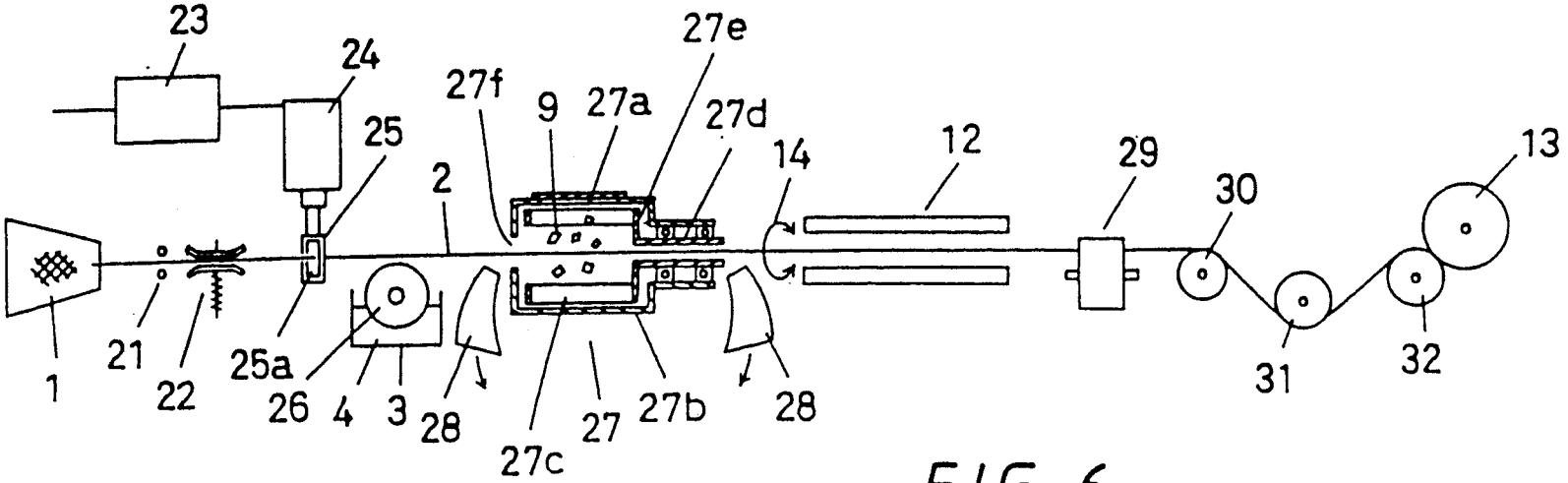
FIG. 4 is a side elevational view of an apparatus according to a third embodiment of the present invention.
Figure 6:
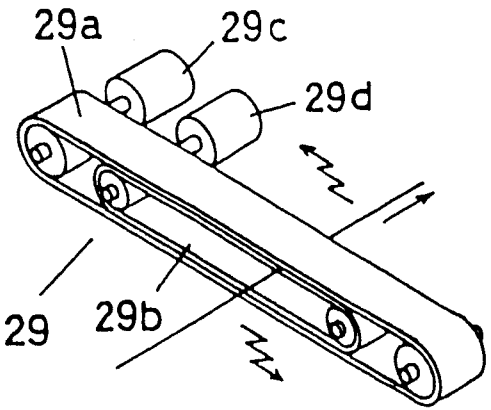
FIG. 6 is a perspective view of a yarn twister of the apparatus shown in FIG. 4.
Figure 5:
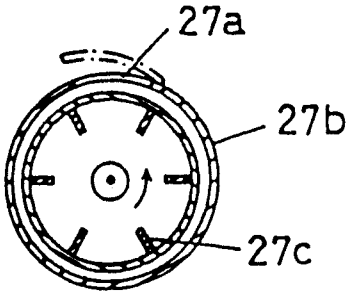
FIG. 5 is a cross-sectional view of a rotary hopper of the apparatus shown in FIG. 4.
Figure 7:
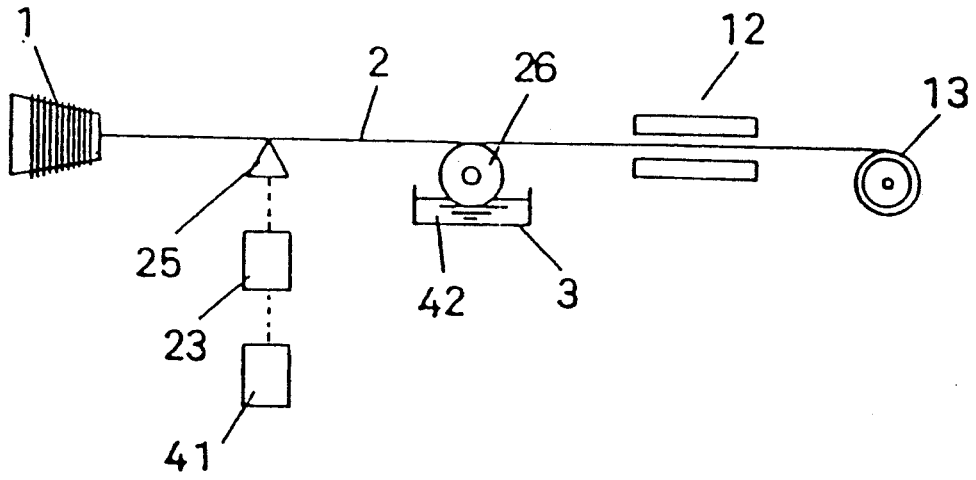
FIG. 7 PRIOR ART
FIG. 7 is a side elevational view of a conventional apparatus.

FIGS. 4 through 6 illustrate an apparatus according to a third embodiment of the present invention. FIG. 4 shows the apparatus in side elevation, FIG. 5 shows a rotary hopper in cross section, and FIG. 6 shows a yarn twister in perspective. A supply bobbin 1, a yarn 2, an adhesive container 3, an adhesive 4, foil pieces 9, a heater 12, and a take-up bobbin 13 shown in FIG. 4 are identical to those according to the first embodiment shown in FIG. 1. The apparatus shown in FIGS. 4 through 6 has a yarn guide 21, a tensioner 22 for tensioning the yarn 2, a driver 23 energizable by a signal from a computer (not shown), a solenoid 24 energizable by the driver 23, a contacting/separating guide 25 that can be moved vertically by the solenoid 24, a transfer roller 26 partly immersed in the adhesive 4 in the adhesive container 3, a rotary hopper 27, suction nozzles 28, a yarn twister 29, guide rollers 30, 31, and a leasing roller 32.

The contacting/separating guide 25 has a passage 25*a* through which the yarn 2 passes. When the contacting/separating guide 25 is elevated, it separates the yarn 2 from the transfer roller 26. When the contacting/separating guide 25 is lowered, it brings the yarn 2 into contact with the upper surface of the transfer roller 26. When the contacting/separating guide 25 is vertically moved in relation to the speed at which the yarn 2 is fed, the intervals at and lengths over which the adhesive 4 is applied to the yarn can be controlled.

As shown in FIG. 5, the rotary hopper 27 comprises rotary blades 27*c* disposed in a fixed cylinder 27*b* that has an opening 27*a* defined in an upper surface thereof and closable by a lid. The rotary blades 27*c* are fixed by a disk plate 27*e* to a hollow shaft 27*d* that is rotatable by a motor (not shown). The rotary blades 27*c* are rotatable closely to the inner surface of the fixed cylinder 27*b*. The yarn 2 with the adhesive 4 applied to local regions thereof passes through the center of rotation of the rotary hopper 27. The foil pieces 9 are introduced into the fixed cylinder 27*b* through the opening 27*a*, and scraped up from the bottom of the fixed cylinder 27*b* by the rotary blades 27*c* as they rotate, so that the foil pieces 9 are scattered over the yarn 2. Any foil pieces 9 that leak out of the fixed cylinder 27*b* through an inlet 27*f* and the end of the hollow shaft 27*d* are recovered by the suction nozzles 28.

As shown in FIG. 6, the yarn twister 29 comprises two belts 29*a*, 29*b* whose respective inner and outer surfaces are held against each other. The belts 29*a*, 29*b* are driven reciprocally in opposite directions by respective motors 29*c*, 29*d*. The yarn 2, which passes between the belts 29*a*, 29*b*, is rotated reciprocally in the directions indicated by the arrows 14 in FIG. 14. More precisely, the belts 29*a*, 29*b* move by small distances in opposite directions while they are being rotated reciprocally in the opposite directions, so that the entire surfaces of the belts 29*a*, 29*b* are put to use in twisting the yarn 2.

According to the third embodiment, the yarn 2 supplied from the supply bobbin 1 is selectively brought into contact with the transfer roller 26 upon vertical movement of the contacting/separating guide 25. Therefore, the regions of the yarn 2 where the adhesive 4 is to be applied can freely be controlled. The intervals between and lengths over which the adhesive 4 is applied to the yarn 2 can uniquely be determined depending on the design of a woven fabric that is to be made of the yarn 2. The contacting/separating guide 25 is thus vertically moved according to the design of such a woven fabric. While the yarn 2 is passing through the rotary hopper 27, the foil pieces 9 are attached to the adhesive-coated regions of the yarn 2, and wrapped around the yarn 2 by swirling air streams developed by the rotation of the rotary blades 27*c* and the reciprocating rotation of the yarn 2 in the yarn twister 29. The foil pieces 9 wrapped around the yarn 2 are fixed in position while passing through the heater 12, and securely pressed against the surface of the yarn 2 while passing between the belts 29*a*, 29*b* of the yarn twister 29.

Field of Industrial Applicability

According to the present invention, a yarn with an adhesive applied thereto is aerially held under tension and fed along, and foil pieces that are aerially scattered are attached to and wrapped around the yarn, thereby producing a fancy yarn. The gloss imparted to the surface of the fancy yarn is highly shiny as it is a metallic gloss given by the foil wrapped around the yarn. The method and apparatus according to the present invention allow a fancy yarn with a shiny metallic gloss to be manufactured simply and inexpensively, and also allow a thin yarn used to weave a thin fabric to be wrapped with a metallic foil as it is attached to the yarn. The yarn thus produced by the method and apparatus according to the present invention is effective to produce a woven fabric of highly ornamental effect.

I claim:

1. A method of manufacturing a metallic-foil-covered fancy yarn, comprising the steps of:

aerially holding a yarn (2) with an adhesive (4) applied thereto horizontally or obliquely under tension;

feeding the yarn (2) in the direction in which the yarn (2) is held under tension;

scattering metallic foil pieces (9) over the yarn (2); and generating relative swirling air streams (19) around the yarn (2).

2. An apparatus for manufacturing a metallic-foil-covered fancy yarn, comprising:

a supply bobbin (1) for supplying a yarn (2);

a take-up bobbin (13) for winding the yarn (2);

a yarn path extending between said supply bobbin (1) and said take-up bobbin (13), for the yarn (2) to be fed therealong from said supply bobbin (1) to said take-up bobbin (13);

an applicator (6, 16 or 26) for applying an adhesive (4) to the yarn (2);

a hopper (8, 27) for scattering metallic foil pieces (9) over the yarn (2);

a heater (12) for hardening the adhesive (4) applied to the yarn (2);

a yarn passage means (17) for generating swirling air streams (19) therein around the yarn (2) passing through the yarn passage (17); and said applicator, said hopper, said heater, and said yarn passage means being arranged successively along said yarn path.

3. A method of manufacturing a metallic-foil-covered fancy yarn, comprising the steps of providing a yarn with adhesive, holding said yarn between two spaced points under tension; moving the yarn in the direction in which the yarn is held under tension; scattering metallic foil pieces over the yarn while generating relative swirling motion between said yarn and said metallic foil pieces to uniformly adhere said foil to said yarn.

4. Apparatus for manufacturing a metallic-foil-covered fancy yarn, comprising a supply bobbin for supplying a continuous yarn; a take-up bobbin for winding the yarn thereon, take-up and supply bobbins being spaced to provide a free yarn path between said bobbins means for moving said yarn between said bobbins; means for applying metallic foil pieces to said moving yarn; and means for generating a relative rotation between said yarn and said scattered foil pieces to cause said pieces to be applied evenly over said yarn.

* * * * *